United States Patent [19]

Muramatsu et al.

[11] Patent Number: 4,867,342

[45] Date of Patent: Sep. 19, 1989

[54] AUTOMATIC CARTON FEEDING DEVICE FOR A LIQUID FILLING MACHINE

[75] Inventors: Mitsuru Muramatsu; Ryuichiro Tominaga, both of Tokyo, Japan

[73] Assignee: Jujo Paper Co., Ltd., Tokyo, Japan

[21] Appl. No.: 72,061

[22] Filed: Jun. 30, 1987

[30] Foreign Application Priority Data

Jul. 1, 1986 [JP] Japan ..... 61-154663

[51] Int. Cl.[4] ..... B65G 65/30

[52] U.S. Cl. ..... 221/11; 221/105; 271/162; 414/924

[58] Field of Search ..... 221/11, 105, 176, 177, 221/180, 288; 414/48, 97, 414, 924; 271/162

[56] References Cited

U.S. PATENT DOCUMENTS 3,655,072 4/1972 Bateman ..... 221/176 X
3,672,118 6/1972 De Jong et al. ..... 414/98 X
3,937,360 2/1976 Doucette ..... 221/11
4,478,327 10/1984 Siniscal et al. ..... 414/414 X
4,530,633 7/1985 Lodi et al. ..... 221/11 X
4,662,624 5/1987 Focke ..... 271/162 X

*Primary Examiner*—Robert J. Spar
*Assistant Examiner*—Janice Krizek
*Attorney, Agent, or Firm*—Armstrong, Nikaido, Marmelstein, Kubovcik & Murray

[57] ABSTRACT

An automatic carton feeding device for a liquid filling machine according to the present invention comprises a carton supply basket assembly divided into an upper and lower basket. The upper basket, which follows the lower basket connected to the liquid filling machine, is installed so as to take an upright and a tumbled position. The lower basket is provided with a receiving plate to receive cartons descending to the lower basket in an upright position of the upper basket. The receiving plate is supported so as to make a vertical motion and lateral retraction using an elevating mechanism.

9 Claims, 1 Drawing Sheet

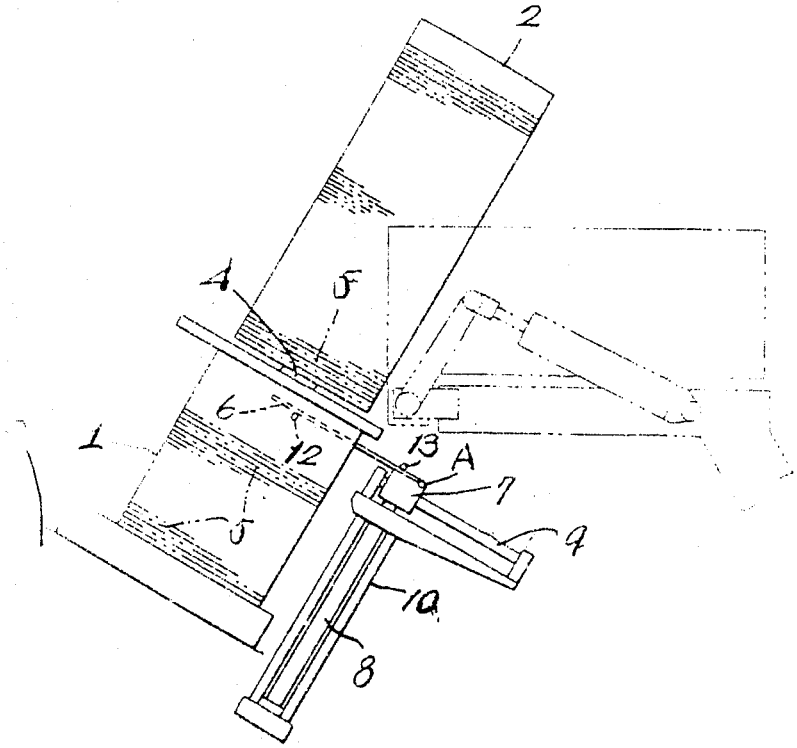
2
4
5
6
1
12
13
A
7
9
5
10
8

AUTOMATIC CARTON FEEDING DEVICE FOR A LIQUID FILLING MACHINE

BACKGROUND OF THE INVENTION

1. Field of the Invention

This invention relates to a device for automatically feeding, to a liquid filling machine, cardboard cartons for retailing milk, juice and other items.

2. Prior Art

In order to feed cartons to a liquid filling machine in the conventional art, a case containing cartons needs to be opened by an operator in order to unload or unpack the cartons. The removed cartons must be fed by the operator to a machine feed port (a basket) located at a certain height.

The above-mentioned conventional construction requires an operator and laborious work.

SUMMARY OF THE INVENTION

An object of this invention is to provide a device for feeding cartons automatically, in order to avoid the above-mentioned labor required in the prior art.

The above-mentioned objects of this invention is accomplished by an automatic carton feeding device for a liquid filling machine comprising a carton feed basket assembly divided into two or an upper and a lower basket. The upper basket follows the lower basket which communicates directly with a liquid filling machine.

The upper basket is installed so as to take upright and tumbled positions. The lower basket is provided with a receiving plate to receive the carton descending from the upper basket to the lower basket in an upright position of the upper basket. The receiving plate is supported so as to make a vertical and lateral motion by means of an elevating mechanism.

BRIEF DESCRIPTION OF THE DRAWINGS

In the accompanying drawing, the single FIGURE is an elevational view of an embodiment of the automatic carton feeding device for a liquid filling machine in accordance with the present invention.

DETAILED DESCRIPTION OF THE PREFERRED EMBODIMENT

In the drawing the numeral 1 denotes a lower basket, and the numeral 2 an upper basket respectively. The lower basket 1 is installed in an inclined position so as to communicate directly with a liquid filling machine body 3. The upper basket 2 is located above the lower basket 1 and is pivotally supported so that the upper basket can take a tumbled position as shown by the two-dot chain line. A gate 4 holds cartons 5, contained in the upper basket 2, in a stacked state when the upper basket is raised in an inclined position. A receiving plate 6 is provided within the lower basket 1 for the cartons 5 and is to move vertically by means of a rodless air cylinder 8.

The receiving plate 6 retracts outside of the lower basket 1 by means of another rodless air cylinders 7 to allow the feeding of the cartons. The numerals 9 and 10 denote the respective guide rod of the rodless air cylinders 7 and 8.

The upper basket 2, containing the cartons for subsequent supply, is pivoted to an inclined position to be in a straight line with the lower basket 1 communicating with the liquid filling machine.

The receiving plate 6 is fixed to the displacing member of the rodless air cylinder 7 to retract from or to project within the lower basket 1. In addition, the rodless air cylinder 7 is fixed to the displacing member of the rodless air cylinder 8 to move in a vertical direction.

When the cartons are fed from the upper basket 2, the rodless air cylinder 8 is raised while another rodless air cylinder 7 is projected. Thus, the receiving plate 6 is in a ready position where it can be inserted within the upper section of the lower basket 1. When the gate 4 of the upper basket is opened, the cartons within the upper basket 2 will descend to be placed on the receiving plate 6. Then the rodless air cylinder 8 will descend and, when a carton level sensor 12, fixed on the underside of the receiving plate 6, detects the carton within the lower basket, the rodless air cylinder 8 terminates its descent to stop there, and at the same time the rodless air cylinder 7 moves outward to retract the receiving plate 6 outside of the lower basket. Therefore, the cartons on the receiving plate 6 will be stacked on the cartons in the lower basket 1.

When the carton level sensor 12 is defective or does not operate for any reason, the receiving plate 6 opens upward around a point A as its pivot. A contact switch 13, fixed on the receiving plate 6, operates to stop the downward motion of the rodless air cylinder 8. This arrangement serves as a safety device for the above-mentioned problem.

When the rodless air cylinder 7 has taken the most retracted position, the rodless air cylinder 8 will ascend to take a ready position for the subsequent operation.

The cartons 5 are transferred to the upper basket 2 when the upper basket is in the tumbled position and then the upper basket 2 is turned to the inclined position in a straight line with the lower basket 1 which is connected to the machine body 3. The present device has been developed to stack the cartons in the upper basket 2 on the cartons 5 remaining in the lower basket 1.

The number of the cartons remaining in the lower basket is usually arbitrary, and the space between these cartons and the cartons in the upper basket is considerably wide because the packer is unpacking the cartons in a carton supply operation. Therefore, the supply of cartons of the upper basket, by freely dropping these cartons through such a wide space, will result in an irregular stack on the remaining cartons, which can cause a problem in the carton supply to the liquid filling machine.

To avoid such a disadvantage, the cartons 5 in the upper basket 2 are firstly received on the receiving plate 6, and then are quietly lowered to the lower basket 1. When the carton level in the lower basket 1 is detected by the photosensor 12, attached to the underside of the receiving plate 6, the descent of the carton elevator terminates, and the receiving plate 6 is retracted outside while leaving the cartons within the lower basket. Thus, the cartons on the elevator are stacked regularly or trued in their edges on the cartons remaining within the lower basket.

By using the device according to the present invention, cartons are automatically fed to a liquid filling machine without an operator.

What is claimed is:

1. An automatic carton feeding device for a liquid filling machine comprising:

a carton supply basket assembly divided into two baskets including an upper basket and a lower basket, said lower basket communicating with a packer, and said upper basket having an upright and a tumbled position, said upper basket being aligned with said lower basket along a common axis when said upper basket is in said upright position;

a receiving plate provided in said lower basket to receive cartons, descending into the lower basket from the upper basket when the upper basket is in the upright position;

an elevating mechanism supporting said receiving plate to make the receiving plate undergo a vertical elevating motion and a lateral retracting motion; and a sensor means located on said receiving plate for detecting the height of said cartons in said lower basket, for stopping said vertical motion of said elevating mechanism and for activating said elevating mechanism to retract laterally.

2. An automatic carton feeding device according to claim 1 further comprising a contact switch for stopping said vertical motion of said elevating mechanism when said sensor means is defective.

3. An automatic carton feeding device according to claim 1 wherein said sensor means is a photosensor.

4. An automatic carton feeding device according to claim 1 wherein said elevating mechanism comprises a first rodless air cylinder for vertical motion and a second rodless air cylinder for lateral motion.

5. An automatic carton feeding device according to claim 4 wherein said first and second rodless air cylinders each include a guide rod.

6. An automatic carton feeding device according to claim 4 wherein said receiving plate is fixed to a displacement member of said second rodless air cylinder to move in a lateral direction.

7. An automatic carton feeding device according to claim 4 wherein said second rodless air cylinder is fixed to a displacement member of said first rodless air cylinder to move in a vertical direction.

8. An automatic carton feeding device according to claim 1 wherein said lower basket communicates with said packer in an inclined position.

9. An automatic carton feeding device according to claim 1 wherein said upper basket includes a gate for holding said cartons in said upper basket in a stacked state.

* * * * *